US006782813B1

(12) United States Patent
Beckmann et al.

(10) Patent No.: US 6,782,813 B1
(45) Date of Patent: Aug. 31, 2004

(54) METHOD FOR THE PRODUCTION OF PRINTED SURFACES

(75) Inventors: Ingo Beckmann, Sulzbach (DE); Jan Kamp, Sulzbach (DE); Stephan Meuter, Saarbrücken (DE)

(73) Assignee: Brightsign GmbH, Saarbrüken (DE)

( * ) Notice: Subject to any disclaimer, the term of this patent is extended or adjusted under 35 U.S.C. 154(b) by 0 days.

(21) Appl. No.: 10/088,392

(22) PCT Filed: Aug. 17, 2000

(86) PCT No.: PCT/EP00/08043

§ 371 (c)(1),
(2), (4) Date: Aug. 26, 2002

(87) PCT Pub. No.: WO01/21415

PCT Pub. Date: Mar. 29, 2001

(30) Foreign Application Priority Data

Sep. 17, 1999 (DE) ..... 199 45 815

(51) Int. Cl.[7] ..... B41M 1/14

(52) U.S. Cl. ..... 101/211; 101/491; 427/157; 427/158; 206/31.64; 252/301.16

(58) Field of Search ..... 101/211, 491; 427/157, 158; 252/301.16, 301.21, 301.36; 106/31.64, 31.9, 420, 452, 471, 479; 430/45

(56) References Cited

U.S. PATENT DOCUMENTS 4,652,464 A * 3/1987 Ludlum et al. ..... 427/157
4,725,316 A * 2/1988 Mahany, II ..... 106/420
5,455,288 A * 10/1995 Needham ..... 523/205
5,734,800 A * 3/1998 Hebert et al. ..... 358/1.9
5,792,380 A * 8/1998 Wen et al. ..... 106/31.64
5,932,139 A * 8/1999 Oshima et al. ..... 252/301.16
6,066,422 A * 5/2000 Blaszak et al. ..... 430/45
2002/0056399 A1 * 5/2002 Schoen et al. ..... 106/31.9

FOREIGN PATENT DOCUMENTS

| | | |
|---|---|---|
| DE | 196 20 090 | 11/1997 |
| EP | 594 765 | 5/1994 |
| WO | 93/01581 | 1/1993 |

* cited by examiner

*Primary Examiner*—Eugene H. Eickholt
(74) *Attorney, Agent, or Firm*—Pauley Petersen & Erickson

(57) ABSTRACT

A method for the production of printed surfaces which are fluorescent under ultraviolet (UV) light uses either a single color or four-color print process in which the base colors of yellow, blue and red and special color tones contain fluorescent pigments, which are not visible under normal light but visible under UV light, in a fixed ratio to the pigments which are colorfast under high intensity light. The method of this invention can be carried out easily to apply and the numerous printing steps previously required are avoided. One advantage is that pictures printed with fluorescent colors appear to give a complete three-dimensional effect at night under UV light with an authentic stepless color reproduction of all tones when daylight effect.

6 Claims, No Drawings

METHOD FOR THE PRODUCTION OF PRINTED SURFACES

BACKGROUND OF THE INVENTION

1. Field of the Invention

This invention relates to a method for producing printed surfaces which fluoresce under ultraviolet (UV) light.

2. Description of Related Art

It is known to use fluorescent dyestuffs in combination with normal dyestuffs for various effects.

Fluorescent dyestuffs are mixed with normal dyestuffs to make the color brighter in daylight. The dyestuffs which are non-visible or fluoresce under ultraviolet light (UV light) are also particularly used in the theatre for special effects, their dramatically fluorescent properties under UV illumination being exploited.

It is known that for use in signs and in advertising, adhesive, fluorescent foils are cut into letters and/or figures, emblems, logos and the like, which for example are stuck to a window pane or to a corresponding pane or panel made of glass, Plexiglas or a similar translucent material that forms a carrier for signs or advertising.

In order to impart the desired, glowing, neon-like effect to the sign or advertisement, it must be illuminated by a so-called non-visible or black light.

An adhesive, fluorescent foil with a translucent layer, which is impermeable or substantially impermeable for UV radiation, is disclosed in PCT International Publication WO-A-93/01581.

A disadvantage in the use of such adhesive, fluorescent foils in the form of cut-to-size letters, figures, emblems, logos and the like, in signs or in advertising is that merely letter features, logos and uniform color areas can be highlighted, and photographic reproductions and pictures in general cannot be depicted in color gradations and transitions. Furthermore, it is disadvantageous that numerous foil characters or patterns must be fabricated and cut in complex individual steps and the individual, monochrome foil patterns must be positioned and glued by hand within the scope of the actual formation of the sign or advertising surface.

A method is known from U.S. Pat. No. 4,652,464, for printing art or advertising graphics using visible and/or non-visible, fluorescent dyestuffs and non-fluorescent dyestuffs in multiple print series of colors, each print series being implemented with one predetermined print pattern. Art and advertising graphics are produced in the printing process with the property of depicting an object with a smooth transition under distinctly different lighting conditions when the object is observed under illuminations which vary between daylight or incandescent light up to UV light.

In this method visible and/or non-visible, fluorescent dyestuffs are used during the printing process, which are applied to previously selected areas of the picture in a predetermined pattern, in order to obtain the desired colors under normal light or daylight and in order to amalgamate these fluorescent dyestuffs with the non-fluorescent dyestuffs under UV light, so that the fluorescent dyestuffs are blended or concealed under normal light.

The relative ratio and the colors and different color tones of the non-fluorescent dyestuffs and of the visible and non-visible, fluorescent dyestuffs are selected in advance, in order to achieve a gradual, fine transition on the picture when it is observed under light conditions which alternate between daylight and UV light, or in order to blend or shade the effect, or in order to reduce the intensity of the fluorescent dyestuffs in specific areas so as to achieve a more natural and gentler effect under UV light.

The disadvantage of the method according to U.S. Pat. No. 4,652,464 is that the printing process must be modified in a complex manner in order to include the application in addition of fluorescent dyestuffs. Also, a printing process is required which is structured in many printing steps with the application of a multiplicity of specific fluorescent dyestuffs and, furthermore, predetermined areas with gradations both of the normal colors and also of the non-visible, fluorescent dyestuffs must be printed, in order to examine the desired effect of not impairing the fluorescent dyestuffs, which are applied to the picture, by the normal daylight dyestuff patterns.

A method for producing surfaces which are luminous at night is known from German Patent Reference DE-A1-196 20 090, in which a wire printer method with luminous colors red, green, blue is used so that the printed surface is luminous at night. In a second print run with translucent colors the motif depicted on the printed surface can also be made visible in daytime. The second print run serves at the same time as UV and reaction protection of the luminous colors.

SUMMARY OF THE INVENTION

One object of this invention is to provide a method that avoids the required multiplicity of printing steps and in particular the complex adjustment of the fluorescent colors in the printing process.

This object is achieved by features of this invention as described in the claims and this specification.

Particular requirements or additional steps are no longer required. Non-visible, fluorescent dyestuffs were not used in the mentioned form in the four-color and multi-color printing method. The advantages of this invention reside particularly in the fact that, instead of a multiplicity of printing steps using non-visible, fluorescent print colors and paints, the normal practice printing steps are implemented. In this connection, as also with four-color and multi-color printing with the conventional primary colors, in the lithographic composition an authentic pictorial reproduction is effected by targeted alteration of the color parameters of each individual print color and in the printing itself a fine adaptation of the perceived color is effected by an alteration of the applied color quantity. This alteration method which is known to any printer can immediately be implemented without special training or other know-how in a non-problematic manner.

DESCRIPTION OF PREFERRED EMBODIMENTS

In one embodiment of this invention, added to the print colors and/or paints are organic pigments in the range of 15% to 20%, fluorescent pigments in the range of 5% to 30% and optically active substances in the range of 0% in one kilogram of color. With these measures, a very weak luminosity of the colors is achieved.

With the measures set forth in claim 3, a weak luminosity of the colors can be achieved, and with the measures set forth in claim 4, an average luminosity of the colors can be achieved. With the measures set forth in claim 5, a strong luminosity of the colors is achieved and finally a very strong luminosity of the colors is achieved with the measures of claim 6.

This invention also extends to a single color printing method. In the case of print colors, it relates to highly colorfast print colors. Special color tones can likewise be taken into account.

By printing with fluorescent colors, the printed reproduction corresponds to the model in its color-fastness and color gradation in daylight and appears as a completely normal poster or advertising surface, though with the effect that by using the fluorescent dyestuffs even in daylight greater luminosity of the colors is already expressed, so that the reproduction strikes the observer substantially sooner than a conventional four-color print poster.

As the most distinctive advantage, the picture which is printed with fluorescent colors, the advertising graphics, advertising surface or the like, glows entirely of its own accord at night under UV light with an authentic color reproduction in comparison with the daylight effect, comparable to the brilliance of a television picture, though even more effectively in all color gradations. Three-dimensional effects are produced in the reproduction with the luminosity of a slide projection and a deep three-dimensional effect is achieved, so that the observer pays particular, attention. Furthermore, the picture surface which is applied to a dark background glows of its own accord at night under UV illumination, since the UV light source, contrary to white light, throws no scattered light.

The printing process according to this invention comprises conventional methods and materials, this invention forming in particular the combination of the function of the elements.

The ratio of a percentage mixture of fluorescent pigments and non-fluorescent pigments varies on the one hand according to the individual colors or color tones, the different print stocks and, on the other hand, according to the printing methods used, for example the offset or the screen print method. The print colors can be described as follows: contentional primary colors and special color tones in combination with organic pigments, fluorescent pigments, and optically active substances, the mixture of organic pigments, fluorescent pigments and optically active substances being effected in different percentage ratios according to the printing method, according to primary colors and special tones and according to print stocks.

A preferred standard value for the ratio is given according to one embodiment of this invention in that the pigment addition to one kilogram of color in the case of organic pigments is in the range of 0.5% to 5%, in the case of fluorescent pigments in the range of 15% to 80% and in the case of optically active substances in the range of 0.5% to 1%.

This invention is described in greater detail by the following example.

Possibly, a photographically reproduced western city silhouette is to be printed, with the back of a person being reproduced in the foreground.

This motif is produced in the four-color printing method by using non-visible, fluorescent print colors and paints, the color gradation being achieved, in the printing process step of the lithographic composition, as also in the case of the conventional four-color printing method, corresponding to the model by means of alteration of the color parameters and a fine adaptation of the perceived color being effected in the print itself by means of a corresponding increase or decrease of the color quantity applied in the printing. The adjustment occurs taking into account the use of fluorescent dyestuffs, which do not correspond to the Euroscale norm, preferably by eye.

The advertising surfaces which fluoresce by means of the proposed method can be produced for any purpose, also therefore for packagings which are used with UV illumination in the gastronomic sphere.

What is claimed is:

1. In a method for producing printed surfaces which fluoresce under an ultraviolet illumination by using print colors and/or paints with pigments which are non-visible in normal light and are visible in an ultraviolet light, the improvement comprising:

setting a defined ratio in a four-color printing method between one group of fluorescent pigments of print colors yellow, blue (cyan) and red (magenta) and special color tones, and a second group of non-fluorescent pigments of the print colors.

2. In the method according to claim 1, wherein to the print colors and/or paints organic pigments are added in a first range of 15% to 20%, fluorescent pigments are added in a second range of 5% to 30%, and optically active substances are added in a third range of 0% in one kilogram of color.

3. In the method according to claim 1, wherein to the print colors, organic pigments are added in a first range of 5% to 15%, fluorescent pigments are added in second range of 10% to 50%, and optically active substances are added in a third range of 0.1% to 0.5% in one kilogram of color.

4. In the method according to claim 1, wherein to the print colors and/or paints organic pigments are added in a first range of 0.5% to 5%, fluorescent pigments are added in a second range of 15% to 80%, and optically active substances are added in a third range of 0.5% to 1% in one kilogram of color.

5. In the method according to claim 1, wherein to the print colors and/or paints organic pigments are added in a first range of 0.5% to 3%, fluorescent pigments are added in a second range of 20% to 85%, and optically active substances are added in a third range of 1% to 2% in one kilogram of color.

6. In the method according to claim 1, wherein to the print colors and/or paints organic pigments are added in a first range of 0.5% to 1%, fluorescent pigments are added in a second range of 2% to 90%, and optically active substances are added in a third range of 2% to 5% in one kilogram of color.

* * * * *